US008280062B2

(12) United States Patent
Fukuda et al.

(10) Patent No.: US 8,280,062 B2
(45) Date of Patent: Oct. 2, 2012

(54) SOUND CORRECTOR, SOUND MEASUREMENT DEVICE, SOUND REPRODUCER, SOUND CORRECTION METHOD, AND SOUND MEASUREMENT METHOD

(75) Inventors: Takashi Fukuda, Tokyo (JP); Toshifumi Yamamoto, Kanagawa (JP); Norikatsu Chiba, Kanagawa (JP); Shigeyasu Iwata, Tokyo (JP); Yasuhiro Kanishima, Tokyo (JP); Kazuyuki Saito, Tokyo (JP); Yutaka Oki, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 460 days.

(21) Appl. No.: 12/535,382

(22) Filed: Aug. 4, 2009

(65) Prior Publication Data

US 2010/0166197 A1 Jul. 1, 2010

(30) Foreign Application Priority Data

Dec. 26, 2008 (JP) ..... 2008-334324

(51) Int. Cl.
*H04R 29/00* (2006.01)

(52) U.S. Cl. ..... 381/58; 381/61; 381/66; 381/98

(58) Field of Classification Search ..... 381/66, 381/74, 309, 98–103, 56–61, 312–321, 71.1–71.14
See application file for complete search history.

(56) References Cited

U.S. PATENT DOCUMENTS 5,960,091 A * 9/1999 White et al. ..... 381/98
6,067,362 A * 5/2000 Lemanski et al. ..... 381/94.1
7,249,511 B2 * 7/2007 Higashihara ..... 73/579
7,787,635 B2 * 8/2010 Higashihara et al. ..... 381/66
8,081,769 B2 * 12/2011 Fukuda et al. ..... 381/71.6
2006/0023893 A1 * 2/2006 Abe ..... 381/59

FOREIGN PATENT DOCUMENTS

| | | | |
|---|---|---|---|
| JP | 53-42721 | | 4/1978 |
| JP | 4-18900 | | 1/1992 |
| JP | H09-187093 | A | 7/1997 |
| JP | 10-117400 | | 5/1998 |
| JP | 2000-092589 | A | 3/2000 |
| JP | 2001-285998 | A | 10/2001 |
| JP | 2002-135898 | A | 5/2002 |
| JP | 2002-209300 | A | 7/2002 |
| JP | 2004-128854 | A | 4/2004 |
| JP | 2008-177798 | | 7/2008 |

OTHER PUBLICATIONS

Japanese Office Action dated Oct. 6, 2009, Japanese Patent Application No. 2008-334324.
Japanese Final Office Action dated Jan. 19, 2010, Japanese Patent Application No. 2008-334324.

* cited by examiner

*Primary Examiner* — Vivian Chin
*Assistant Examiner* — Fatimat O Olaniran
(74) *Attorney, Agent, or Firm* — Patterson & Sheridan, LLP

(57) ABSTRACT

According to one embodiment, a sound corrector includes a signal outputter, a response signal, a frequency specifier, a coefficient specifier, a filter, and an outputter. The signal outputter outputs a measurement signal to measure acoustical properties of an object to be measured. The response signal receiver receives a response signal from the object in response to the measurement signal. The frequency specifier specifies a resonant frequency at a resonance peak from the response signal. The coefficient specifier specifies a correction coefficient of a correction filter for reducing the resonant frequency based on the specified resonant frequency. The filter performs filtering on a signal to be output to the object using the correction filter with the correction coefficient. The outputter outputs the signal having undergone the filtering to the object.

8 Claims, 15 Drawing Sheets

MEASURE ACOUSTICAL PROPERTIES?
0. NOT MEASURE ACOUSTICAL PROPERTIES
1. MEASURE ACOUSTICAL PROPERTIES OF BOTH EARS
2. MEASURE ACOUSTICAL PROPERTIES OF RIGHT EAR
3. MEASURE ACOUSTICAL PROPERTIES OF LEFT EAR
4. MEASURE ACOUSTICAL PROPERTIES LATER (AFTER_HOURS)

SOUND CORRECTOR, SOUND MEASUREMENT DEVICE, SOUND REPRODUCER, SOUND CORRECTION METHOD, AND SOUND MEASUREMENT METHOD

CROSS-REFERENCE TO RELATED APPLICATIONS

This application is based upon and claims the benefit of priority from Japanese Patent Application No. 2008-334324, filed Dec. 26, 2008, the entire contents of which are incorporated herein by reference.

BACKGROUND

1. Field

One embodiment of the invention relates to a sound corrector that reduces the resonance peak of a signal, a sound measurement device, a sound reproducer, a sound correction method, and a sound measurement method.

2. Description of the Related Art

Portable sound reproducers have been commonly used to listen to music playback or the like through a headphone or an earphone. When a user listens to music or the like with a headphone or an earphone, the headphone or the earphone blocks the ear canal, and thereby a resonance phenomenon occurs. The resonance phenomenon causes unnatural sound quality. Accordingly, to prevent the resonance phenomenon, there have been proposed various technologies.

For example, Japanese Patent Application Publication (KOKAI) No. 2000-92589 discloses a conventional technology using a microphone integrated earphone. With this conventional technology, the acoustical properties of the ear canal are measured by using the microphone integrated earphone. Then, the acoustical properties are corrected with an adaptive equalization filter.

For another example, Japanese Patent Application Publication (KOKAI) No. 2002-209300 discloses a conventional technology using a dummy head. With this conventional technology, the acoustical properties of the ear canal are measured at the position of the eardrum by using the dummy head. Then, a correction filter is created based on the acoustical properties to correct the acoustical properties with the correction filter.

For still another example, Japanese Patent Application Publication (KOKAI) No. H09-187093 discloses a conventional technology in which a filter is created to reduce measured resonance peaks.

In the case of the conventional technology using a microphone integrated earphone, the properties of the microphone is included in the acoustical properties to be adaptively equalized. Besides, the acoustical properties cannot be appropriately corrected depending on the position of the microphone.

In the case of the conventional technology using a dummy head, the ear canal varies among different individuals, and also there is a difference in properties between the left and right ear canals of a person. Therefore, with the correction filter created based on the acoustical properties measured using the dummy head, the desired effect cannot be achieved.

Further, Japanese Patent Application Publication (KOKAI) No. H09-187093 discloses the technology in which a filter is created to reduce measured resonance peaks, but it does not specifically describe how to create the filter. Generally, a reverse filter of measured data or a parametric equalizer is used. However, since the measurement cannot be performed at the position of the eardrum, an accurate correction cannot be achieved. In addition, there are numerous parameters in a parametric approach, and therefore, tuning is difficult and the desired properties cannot be obtained.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

Figure 1:
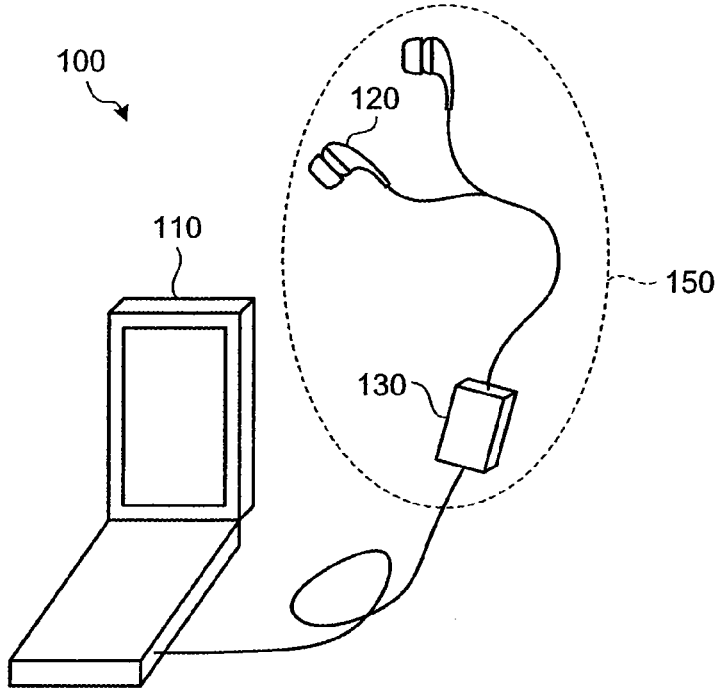
FIG. 1 is an exemplary schematic diagram of a sound reproducer according to a first embodiment of the invention.

Various embodiments according to the invention will be described hereinafter with reference to the accompanying drawings. In general, according to one embodiment of the invention, a sound corrector comprises a signal outputter, a response signal, a frequency specifier, a coefficient specifier, a filter, and an outputter. The signal outputter is configured to output a measurement signal to measure acoustical properties of an object to be measured. The response signal receiver is configured to receive a response signal from the object to be measured in response to the measurement signal. The frequency specifier is configured to specify a resonant frequency at a resonance peak from the response signal. The coefficient specifier configured to specify a correction coefficient of a correction filter for reducing the resonant frequency based on the resonant frequency specified by the frequency specifier. The filter is configured to perform filtering on a signal to be output to the object to be measured using the correction filter with the correction coefficient specified by the coefficient specifier. The outputter is configured to output the signal having undergone the filtering to the object to be measured.

According to another embodiment of the invention, a sound measurement device comprises a signal outputter, a response signal receiver, a frequency specifier, a coefficient specifier, and a coefficient outputter. The signal outputter is configured to output a measurement signal to measure acoustical properties of an object to be measured. The response signal receiver is configured to receive a response signal reflected from the object to be measured. The frequency specifier is configured to specify a resonant frequency at a resonance peak from the response signal. The coefficient specifier is configured to specify a correction coefficient of a correction filter for reducing the resonant frequency based on the resonant frequency specified by the frequency specifier. The coefficient outputter is configured to output the correction coefficient specified by the coefficient specifier.

According to still another embodiment of the invention, a sound reproducer comprises a signal outputter, a response signal receiver, a frequency specifier, a coefficient specifier, a signal generator, a filter, and an outputter. The signal outputter is configured to output a measurement signal to measure acoustical properties of an object to be measured. The response signal receiver is configured to receive a response signal from the object to be measured in response to the measurement signal. The frequency specifier is configured to specify a resonant frequency at a resonance peak from the response signal. The coefficient specifier is configured to specify a correction coefficient of a correction filter for reducing the resonant frequency based on the resonant frequency specified by the frequency specifier. The signal generator is configured to generate a signal to be output to the object to be measured. The filter is configured to perform filtering on the signal generated by the signal generator using the correction filter with the correction coefficient specified by the coefficient specifier. The outputter is configured to output the signal having undergone the filtering to the object to be measured.

According to still another embodiment of the invention, there is provided a sound correction method applied to a sound corrector. The sound correction method comprises: a signal outputter outputting a measurement signal to measure acoustical properties of an object to be measured; a response signal receiver receiving a response signal from the object to be measured in response to the measurement signal; a frequency specifier specifying a resonant frequency at a resonance peak from the response signal; a coefficient specifier specifying a correction coefficient of a correction filter for reducing the resonant frequency based on the resonant frequency specified by the frequency specifier; a filter performing filtering on a signal to be output to the object to be measured using the correction filter with the correction coefficient specified by the coefficient specifier; and an outputter outputting the signal having undergone the filtering to the object to be measured.

According to still another embodiment of the invention, there is provided a sound measurement method applied to a sound measurement device. The sound measurement method comprises: a signal outputter outputting a measurement signal to measure acoustical properties of an object to be measured; a response signal receiver receiving a response signal reflected from the object to be measured; a frequency specifier specifying a resonant frequency at a resonance peak from the response signal; a coefficient specifier specifying a correction coefficient of a correction filter for reducing the resonant frequency based on the resonant frequency specified by the frequency specifier; and a coefficient outputter outputting the correction coefficient specified by the coefficient specifier.

FIG. 1 is a schematic diagram of a sound reproducer 100 to which is applied an acoustic characteristic correction device according to a first embodiment of the invention. As illustrated in FIG. 1, the sound reproducer 100 comprises an acoustic characteristic correction device 150 and a mobile telephone 110. The acoustic characteristic correction device 150 comprises an earphone 120 and a main body 130.

Inside the mobile telephone 110, an audio data generator (not illustrated) generates (reproduces) audio data and outputs the audio data to the acoustic characteristic correction device 150. Upon receipt of the audio data, the acoustic characteristic correction device 150 corrects the acoustical properties of the audio data (sound source signal) and then outputs an acoustic signal obtained by the correction to an object to be measured through the earphone 120. In the first embodiment, it is assumed, for example, that the ear canal of the user is the object to be measured. The earphone 120 is provided with a built-in microphone 330, which will be described later. Described below is the earphone 120.

Figure 2:
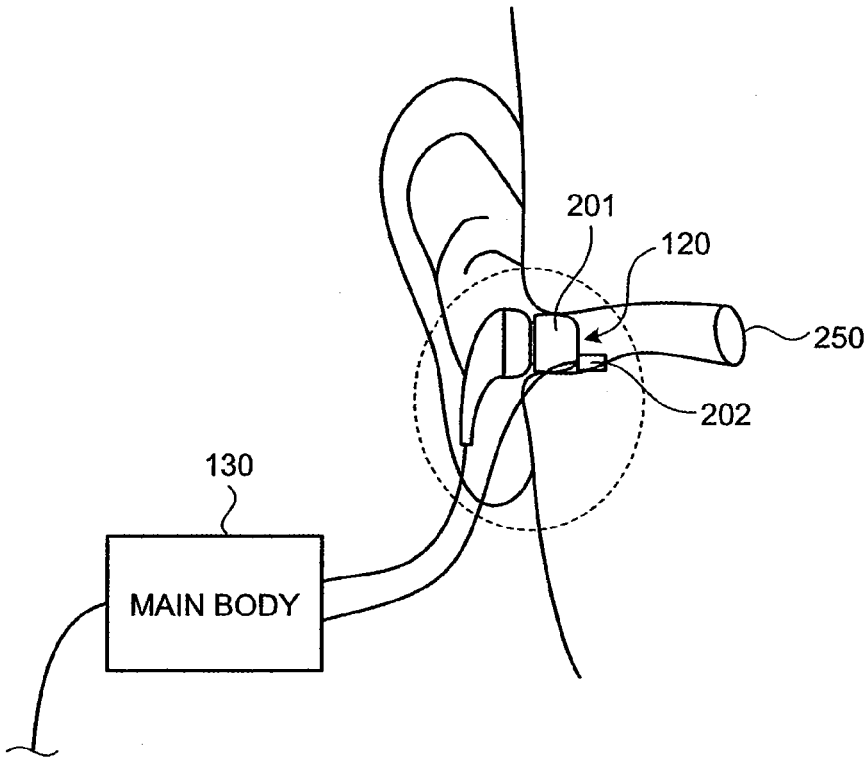
FIG. 2 is an exemplary conceptual diagram of an earphone used to correct acoustical properties and the surrounding environment in the first embodiment.

FIG. 2 is a conceptual diagram of the earphone 120 used to correct acoustical properties and the surrounding environment. As illustrated in FIG. 2, the earphone 120 is placed in the entrance of the ear canal. The earphone 120 comprises a sound output module 201 (sound tube). Near the sound output module 201 is located a sound input module 202 of the microphone 330. The sound output module 201 and the sound input module 202 are each electrically connected to the main body 130 of the acoustic characteristic correction device 150. An acoustic signal output from the sound output module 201 reaches the position of an eardrum through the ear canal, i.e., an object to be measured 250.

In the example of FIG. 2, the sound input module 202 of the microphone 330 is illustrated as being separate from the earphone 120 so that it is clearly visible. However, the sound input module 202 is in practice located inside the earphone 120 near the sound output module 201.

Figure 3:
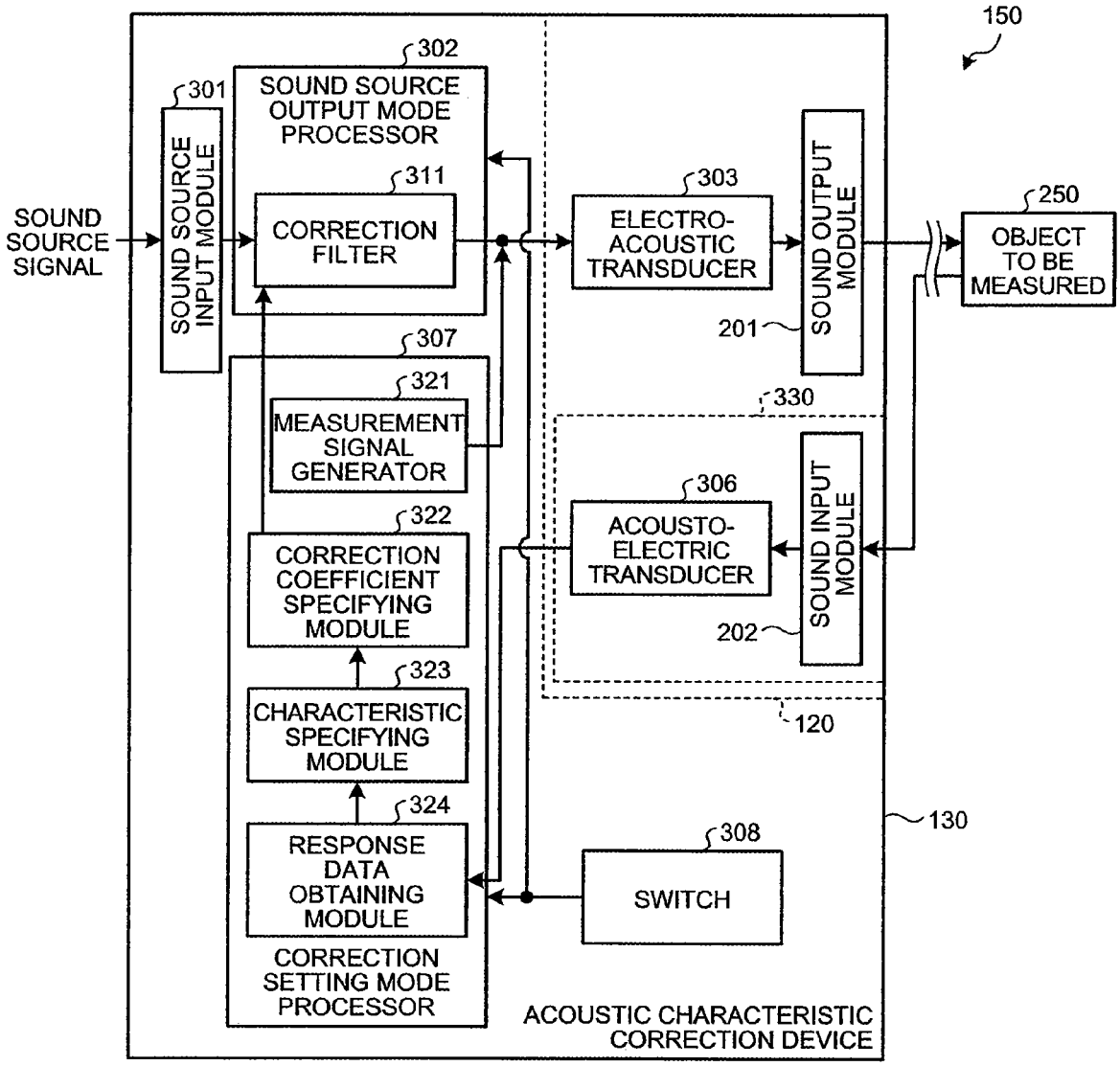
FIG. 3 is an exemplary block diagram of an acoustic characteristic correction device in the first embodiment.

FIG. 3 is a block diagram of the acoustic characteristic correction device 150 of the first embodiment. As illustrated in FIG. 3, the acoustic characteristic correction device 150 comprises the earphone 120 and the main body 130.

The earphone 120 comprises an electroacoustic transducer 303, the sound output module 201, and the microphone 330. The microphone 330 comprises the sound input module 202 and an acoustoelectric transducer 306. For example, a speaker provided to the earphone 120 functions as both the electroacoustic transducer 303 and the sound output module 201.

Upon receipt of an electrical signal as a sound source signal from the main body 130, the electroacoustic transducer 303 converts the sound source signal to an acoustic signal. The sound output module 201 outputs the acoustic signal.

The sound input module 202 of the microphone 330 receives an acoustic signal from the ear canal of the user. In the first embodiment, when the sound output module 201 outputs an acoustic signal for measurement (hereinafter, "measurement acoustic signal"), the sound input module 202 receives a signal (hereinafter, "response acoustic signal") in response to the measurement acoustic signal. As has been described above, the sound input module 202 is located near the sound output module 201.

Upon receipt of an acoustic signal (a response acoustic signal), the acoustoelectric transducer 306 converts the response acoustic signal to an electrical signal. The electrical signal converted from the response acoustic signal will be hereinafter referred to as "response signal".

If the resonant frequency can be eliminated at the position of the eardrum, it means that an appropriate correction has been performed for the user. However, it is difficult to place the microphone at the position of the eardrum of the user each time the user uses the microphone. Therefore, according to the first embodiment, the microphone 330 is built in the earphone 120.

Figure 4:
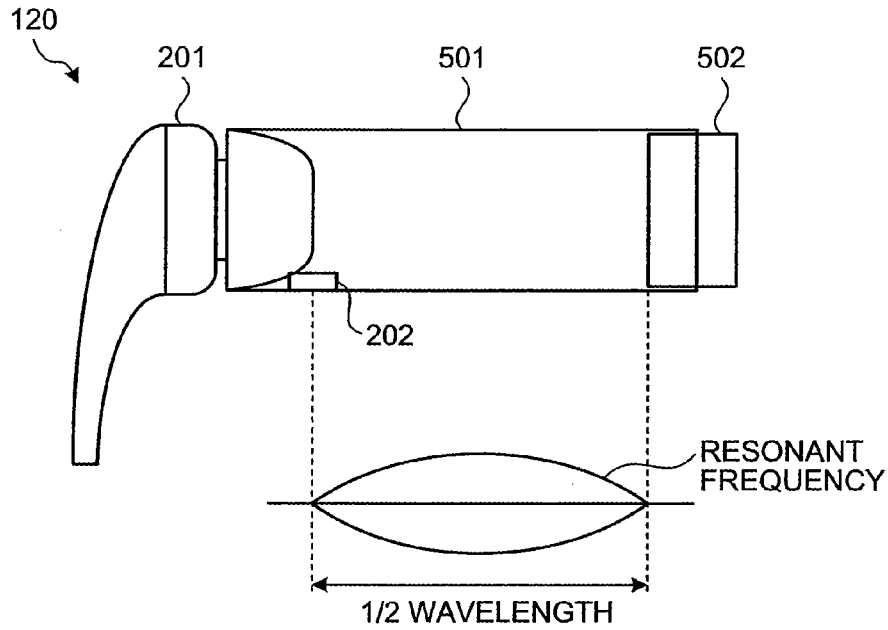
FIG. 4 is an exemplary conceptual diagram for explaining a comparison experiment to measure the difference between the position of the eardrum and the entrance of the ear canal when an earphone is placed in a resonance tube as a model of the ear canal in the first embodiment.

A description will now be given of a comparison experiment between the case where the microphone is located near the earphone 120 and the case where the microphone is located at the position of an eardrum 502. FIG. 4 is a conceptual diagram for explaining the comparison experiment in measurement by the microphone located at the position of the eardrum 502 and the microphone (the sound input module 202) located near the entrance of the ear canal when the earphone 120 is placed in a resonance tube 501 as a model of the ear canal. As can be seen from FIG. 4, the gain of frequency characteristics of the microphone (the sound input module 202) located near the entrance of the ear canal of the first embodiment and that of the microphone located at the position of the eardrum 502 is measured.

Incidentally, the resonant frequency corresponds to a frequency having a wavelength twice the distance between the sound output module 201 of the earphone 120 and the position of the eardrum 502.

Figure 5:
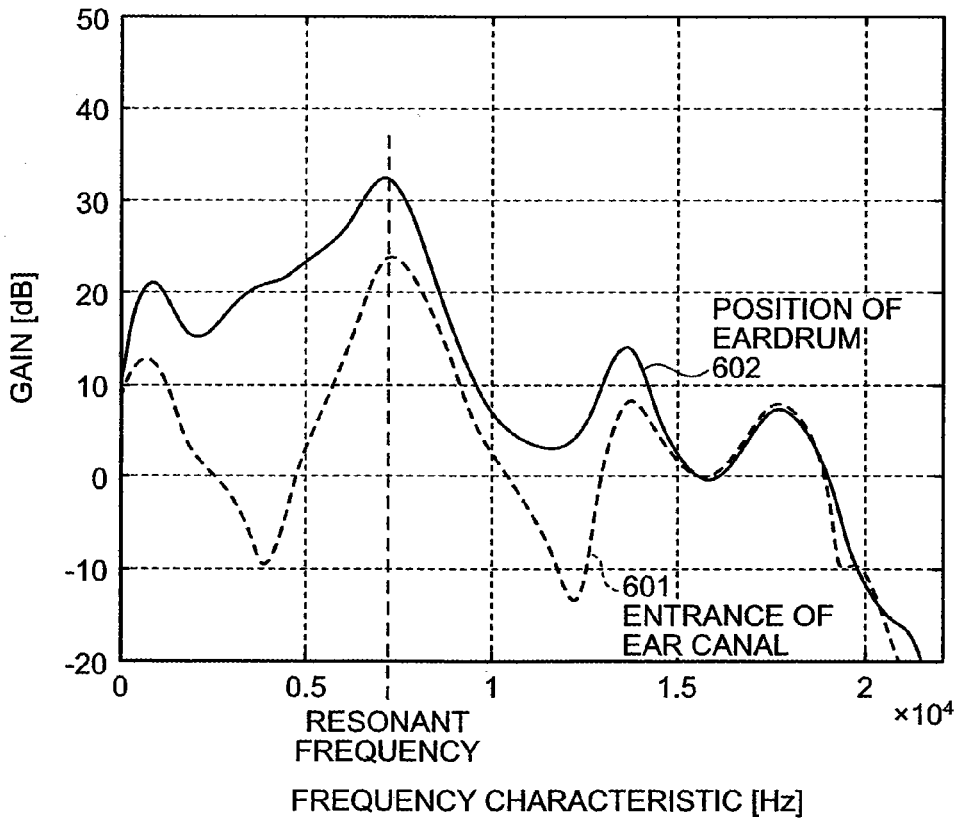
FIG. 5 is an exemplary graph of the gain of frequency characteristics at the position of the eardrum and the gain of frequency characteristics at the entrance of the ear canal obtained by the comparison experiment using the resonance tube illustrated in FIG. 4 in the first embodiment.

FIG. 5 is a graph of the gain of frequency characteristics at the position of the eardrum 502 and the gain of frequency characteristics at the entrance of the ear canal (near the earphone 120). As illustrated in FIG. 5, the gain of frequency characteristics at the entrance of the ear canal indicated by dotted line 601 does not match the gain of frequency characteristics at the position of the eardrum indicated by solid line 602. Therefore, if the sound output module 201 outputs an acoustic signal after filtering with a reverse filter obtained from a response signal received at the entrance of the ear canal, the user who listens to sound corresponding to the acoustic signal feels that the sound quality has degraded.

However, the frequency characteristics (resonant frequencies) substantially match at resonance peaks between the entrance of the ear canal and the position of the eardrum. For this reason, according to the first embodiment, an acoustic model is created using the fact that the resonant frequencies substantially match at resonance peaks. The acoustic characteristic correction device 150 of the first embodiment uses the acoustic model thus created, and thereby is capable of correction with less degradation in sound quality. That is, by setting a correction coefficient to counteract the peak of the resonant frequency measured at the entrance of the ear canal (near the earphone 120), it is possible to counteract the peak of the resonant frequency at the position of the eardrum.

Figure 6:
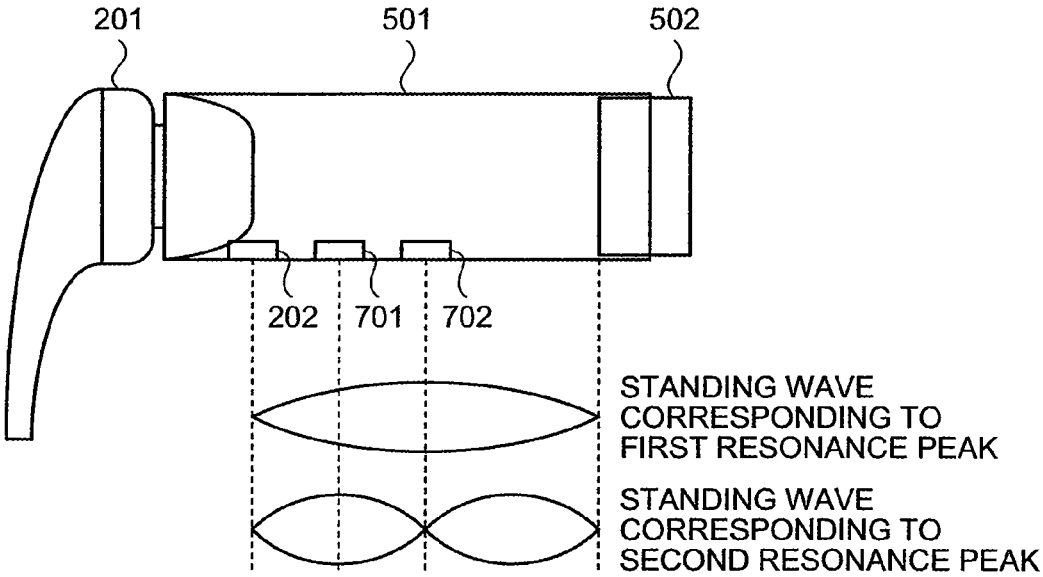
FIG. 6 is an exemplary schematic diagram for explaining a comparison experiment in acoustical properties by using a plurality of microphones located at different positions in the resonance tube as a model of the ear canal in the first embodiment.

In the following, the reason will be described why the microphone is arranged near the sound output module 201 of the earphone 120. FIG. 6 is a schematic diagram for explaining a comparison experiment in acoustical properties by using a plurality of microphones located at different positions in the resonance tube 501 as a model of the ear canal. As illustrated in FIG. 6, a microphone 702 is located at the antinode of sound pressure of a standing wave corresponding to the first resonance peak. Meanwhile, a microphone 701 is located at the antinode of sound pressure of a standing wave corresponding to the second resonance peak. A description will be given of the case where the microphones 701 and 702 located at the different positions each receive a response acoustic signal in response to a measurement acoustic signal output from the sound output module 201 of the earphone 120.

Figure 7:
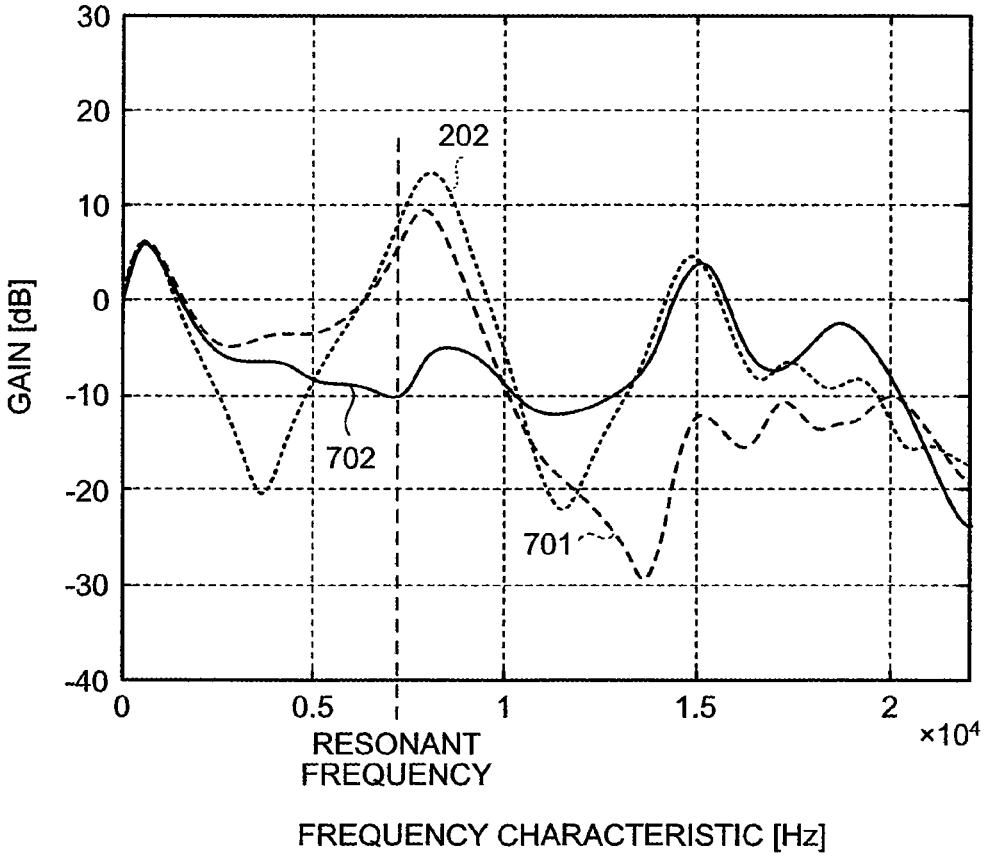
FIG. 7 is an exemplary graph of frequency characteristics as the result of analyzing response acoustic signals received by the microphones illustrated in FIG. 6 in the first embodiment.

FIG. 7 is a graph of frequency characteristics as the result of analyzing response acoustic signals received by the microphones 701 and 702. As illustrated in FIG. 7, if the microphones are located at different positions, the resonance peaks do not match. In other words, if a microphone is arranged at the node of a standing wave, the peak of the standing wave cannot be taken. As a result, it becomes difficult to specify the frequency characteristics at the resonance peak. Thus, it can be understood that the microphone needs to be arranged at a position other than the node of a standing wave. Therefore, according to the first embodiment, the microphone is arranged near the sound output module 201 of the earphone 120 as a position other than the node of sound pressure of a standing wave.

Figure 8:
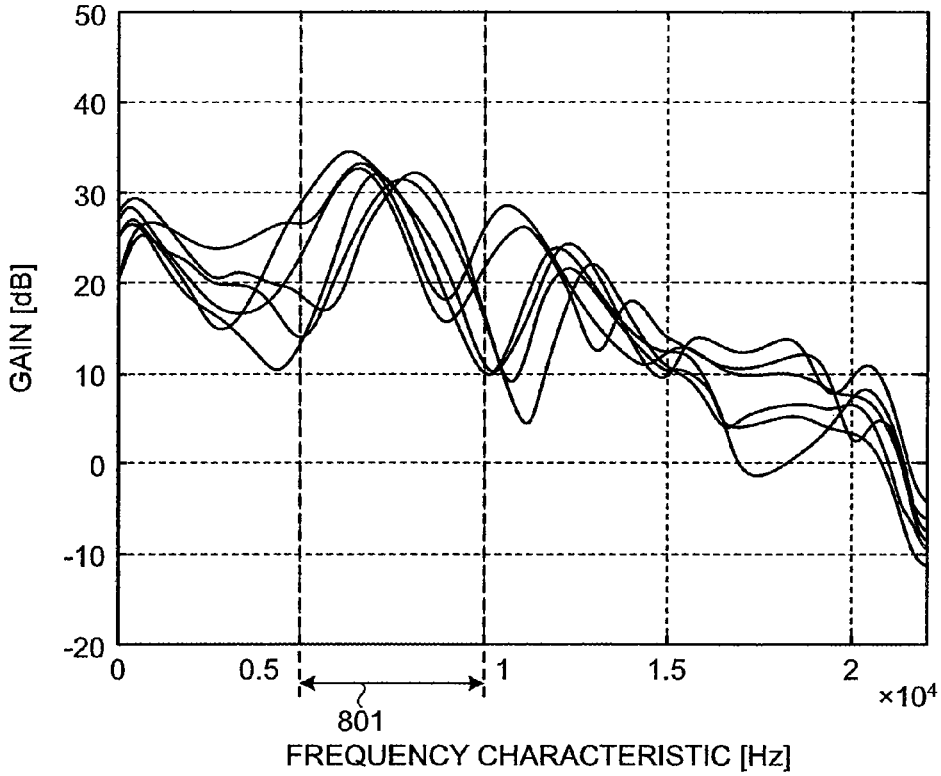
FIG. 8 is an exemplary graph of frequency characteristics specified for each user by the acoustic characteristic correction device in the first embodiment.

Described next is the effect of the individual correction. FIG. 8 is a graph of frequency characteristics specified for each user by the acoustic characteristic correction device 150. FIG. 8 illustrates the frequency characteristics in the left ear of each user. As illustrated in FIG. 8, the resonant frequency at the peak varies depending on each user. For example, the first resonance peaks range from about 5 kHz to 10 kHz as indicated by double headed arrow 801. Similarly, the second resonance peaks range from about 9 kHz to 15 kHz. As just described, since the frequency characteristics vary depending on each user, correction needs to be performed with a correction coefficient appropriate for each user.

Figure 9:
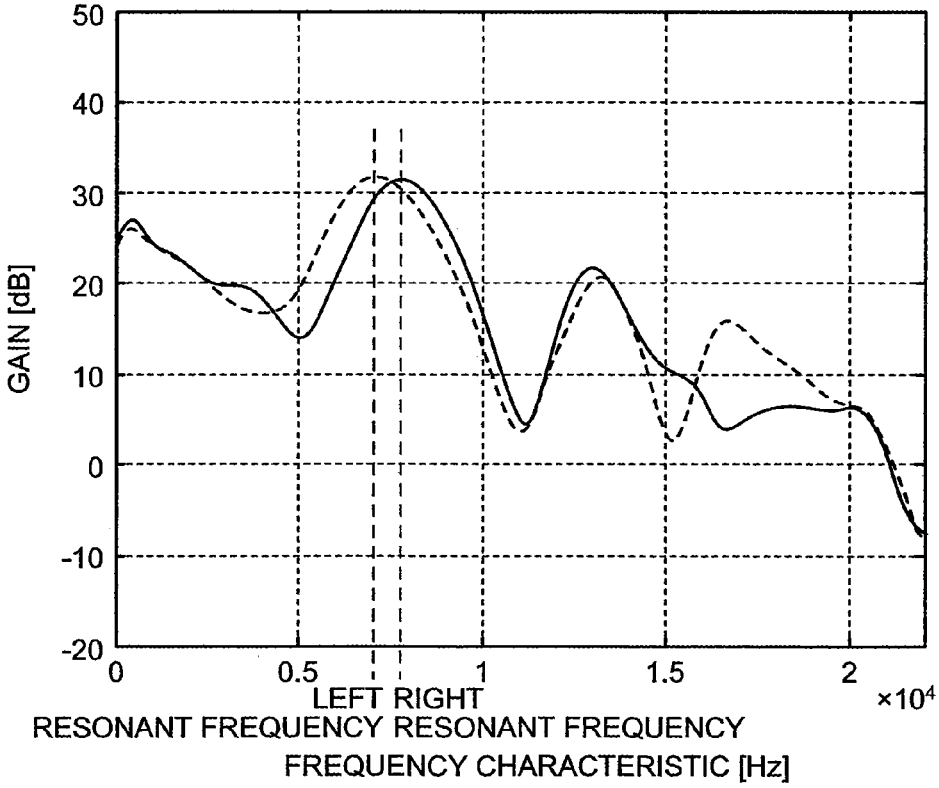
FIG. 9 is an exemplary graph of frequency characteristics for each ear of the same user in the first embodiment.

Further, the frequency characteristics differ between the left and right ears of the same user. FIG. 9 is a graph of frequency characteristics for each ear of the same user. In the example of FIG. 9, the resonant frequency at the first resonance peak in the right ear differs the resonant frequency at the first resonance peak in the left ear by about 1 kHz. In this manner, the resonant frequency varies depending on each ear.

Thus, the acoustic characteristic correction device 150 of the first embodiment specifies a resonant frequency with respect to each ear, and performs correction according to the specified resonant frequency. With this, the acoustic characteristic correction device 150 can perform appropriate correction with respect to each ear.

Referring back to FIG. 3, the main body 130 comprises a sound source input module 301, a sound source output mode processor 302, a correction setting mode processor 307, and a switch 308. The sound source output mode processor 302 is provided with a correction filter 311.

The acoustic characteristic correction device 150 of the first embodiment is provided with two types of processing modes. One of the processing modes is correction setting mode to measure the frequency characteristics of the ear canal of the user and specify a correction coefficient used in the correction filter 311. The other of the processing modes is sound source output mode to output, after the correction of a sound source signal by the correction filter 311 using the specified correction coefficient, the sound source signal as an acoustic signal.

In the first embodiment, it is assumed that the frequency characteristics used for correction are the characteristics of a frequency at which resonance occurs in the ear canal in which the earphone 120 is placed. Besides, the first embodiment describes the case where the resonant frequency and the gain of the resonant frequency are used as the physical quantity of frequency characteristics.

The switch 308 switches the processing mode between the correction setting mode and the sound source output mode. In the correction setting mode, the correction setting mode processor 307 performs processing to set a correction filter. On the other hand, in the sound source output mode, the sound source output mode processor 302 processes a sound source signal received by the sound source input module 301, and then outputs an acoustic signal to the object to be measured.

In the first embodiment, the sound source signal refers to an electrical signal received from the mobile telephone 110 as audio data, while the acoustic signal refers to sound output from the sound output module 201 of the earphone 120.

Figures 10, 11:
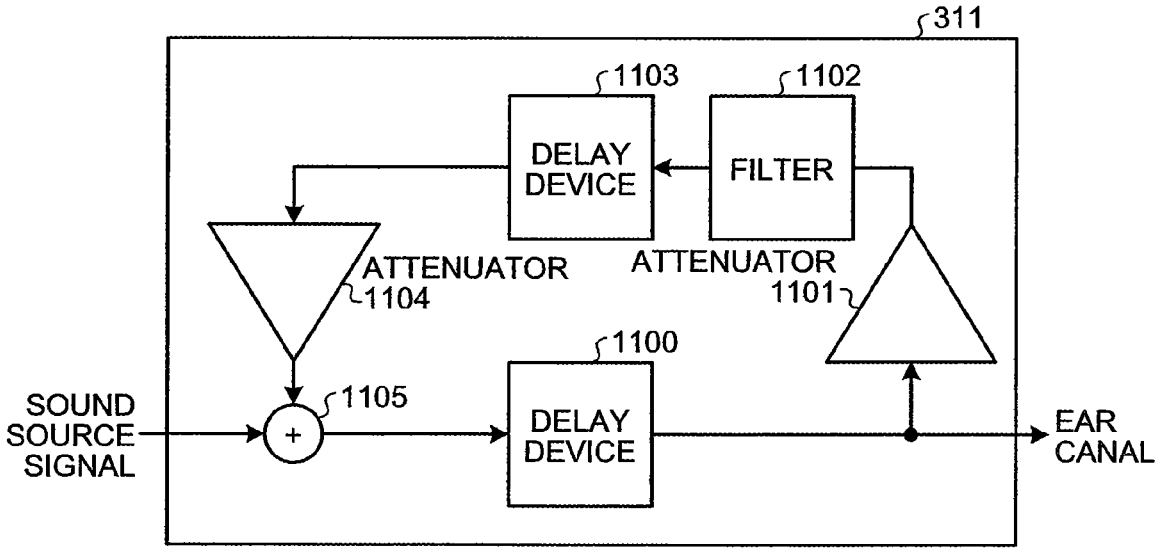
FIG. 10 is an exemplary schematic diagram of screen display provided when acoustical properties are measured in the first embodiment.
FIG. 11 is an exemplary schematic diagram of an acoustic model created by a correction coefficient specifying module used for a correction filter in the first embodiment.

The acoustic characteristic correction device 150 of the first embodiment displays a screen for switching the processing modes on the mobile telephone 110. FIG. 10 illustrates an example of the screen for switching the processing modes. In the example of FIG. 10, if the user selects "0. not measure acoustical properties", the switch 308 switches the processing mode to the sound source output mode. On the other hand, if the user selects other options, the switch 308 switches the processing mode to the correction setting mode.

The correction setting mode processor 307 comprises a measurement signal generator 321, a correction coefficient specifying module 322, a characteristic specifying module 323, and a response data obtaining module 324. In the first embodiment, when the switch 308 switches the processing mode to the correction setting mode, the respective modules perform processing triggered by the generation of a measurement reference signal by the measurement signal generator 321.

The measurement signal generator 321 generates a measurement reference signal representing an electrical signal to measure the acoustical properties (frequency characteristics) of the ear canal. The measurement reference signal is a predetermined electrical signal to measure the acoustical properties of the ear canal.

The measurement reference signal generated by the measurement signal generator 321 is converted to an acoustic signal by the electroacoustic transducer 303.The acoustic signal converted from the measurement reference signal serves as a measurement acoustic signal. The term "measurement acoustic signal" as used herein refers to one of a unit pulse, a time stretched pulse, white noise, noise in a band including a measurement band, and a signal containing a plurality of sinusoidal waves including a sinusoidal wave in the measurement band.

The measurement acoustic signal obtained by the electroacoustic transducer 303 is output from the sound output module 201. After that, the sound input module 202 receives a response acoustic signal (i.e., reflected sound) in response to the output measurement acoustic signal. The response acoustic signal received by the sound input module 202 is converted to an electrical signal by the acoustoelectric transducer 306. The electrical signal converted from the response acoustic signal serves as a response signal.

The response data obtaining module 324 obtains the response signal. The response signal refers to an electrical signal converted from a response acoustic signal reflected from the ear canal. The characteristic specifying module 323 analyzes the response signal so that the correction coefficient specifying module 322 can obtain an appropriate correction coefficient.

The characteristic specifying module 323 analyzes the frequency characteristics of the response signal to specify the acoustical properties of the ear canal. The characteristic specifying module 323 of the first embodiment specifies the sound pressure level at the resonance peak and a resonant frequency corresponding to the resonance peak by analyzing the response signal. The characteristic specifying module 323 specifies an appropriate resonance peak such as, for example, the first resonance peak and the second resonance peak depending on the shape of the object to be measured. Incidentally, the characteristic specifying module 323 may specify the resonant frequency using any methods including commonly known ones.

The correction coefficient specifying module 322 specifies a correction coefficient based on the acoustical properties (frequency characteristics) specified by the characteristic specifying module 323. The correction coefficient specifying module 322 of the first embodiment creates an acoustic model based on the peak of the gain (the sound pressure level at the resonance peak) and the resonant frequency corresponding to the resonance peak. Further, the correction coefficient specifying module 322 applies an adaptive equalization filter to the acoustic model thus created to specify a correction coefficient of a correction filter to eliminate the resonance peak. In the first embodiment, the correction coefficient specifying module 322 specifies, for example, delay time as the correction coefficient.

For example, the relation between sonic speed (V), frequency (f), and wavelength (v) is expressed by the following Equation (1):

$$V=fv \tag{1}$$

Naturally, the sonic speed (V) is a known value.

The distance between the entrance of the ear canal (the position of the sound output module 201 of the earphone 120) and the position of the eardrum is represented by ½v. That is, if the resonant frequency is specified, then the distance between the entrance of the ear canal and the position of the eardrum is specified. The correction coefficient specifying module 322 is also capable of specifying the propagation time that an acoustic signal takes to travel the distance.

In this manner, the correction coefficient specifying module 322 creates an acoustic model of the ear canal for correction based on the peak of the gain (the sound pressure level at the resonance peak) and the resonant frequency corresponding to the resonance peak. By applying an adaptive equalization filter to the acoustic model thus created, the correction coefficient specifying module 322 specifies a correction coefficient of a correction filter to reduce the component of specified resonant frequency. For example, the correction coefficient specifying module 322 specifies the propagation time to be set to a delay device that constitutes the acoustic model used for the correction filter to eliminate the resonance peak of the specified resonant frequency.

In addition, the correction coefficient specifying module 322 specifies the propagation time (delay time) of a sonic wave in the ear canal based on the detected resonant frequency, and also reflectivity based on the sound pressure level at the resonance peak.

The sound source input module 301 receives a sound source signal that is the basis of an acoustic signal fed to the ear canal.

As described above, the sound source output mode processor 302 comprises the correction filter 311. When the switch 308 switches the processing mode to the sound source output mode, the correction filter 311, the electroacoustic transducer 303, and the sound output module 201 perform processing on a sound source signal received by the sound source input module 301 in the manner described below.

The correction filter 311 performs filtering on the input sound source signal based on a correction coefficient set with an acoustic model to thereby perform correction. FIG. 11 illustrates an example of an acoustic model created by the correction coefficient specifying module 322 used for the correction filter 311.

As illustrated in FIG. 11, the acoustic model comprises delay devices 1103 and 1100, attenuators 1101 and 1104, a filter 1102, and an adder 1105. A specified delay time is set to each of the delay devices 1103 and 1100. A sound source signal is returned through these constituent elements (the delay devices 1103 and 1100, the attenuators 1101 and 1104, and the filter 1102) and then added to an input acoustic signal by the adder 1105. With such an acoustic model and an adaptive equalization filter, it is possible to realize a filter with a parameter (correction coefficient) based on the physical quantity of acoustical properties. Incidentally, various types of adaptive equalization filters, including known ones, may be used and further description is not considered necessary.

A propagation time (delay time) specified by the correction coefficient specifying module 322 is set to each of the delay devices 1103 and 1100. By setting a propagation time corresponding to resonance peaks, the resonance peaks can be reduced.

To the attenuator 1101 is set the reflectivity of the eardrum from the eardrum side specified by the correction coefficient specifying module 322. In the first embodiment, the reflectivity is set by the correction coefficient specifying module 322 based on the sound pressure level at the resonance peak.

The filter 1102 introduces frequency dependency to the reflectivity. In the first embodiment, a high pass filter is used as the filter 1102 taking into account that the reflection is small in the low frequency band. The filter 1102 is designed to allow signals to pass in the low frequency band compared to the high frequency band because resonance does not occur in the low frequency band. While, in the first embodiment, a high pass filter is used as the filter 1102, a bandpass filter may also be used.

Figure 12:
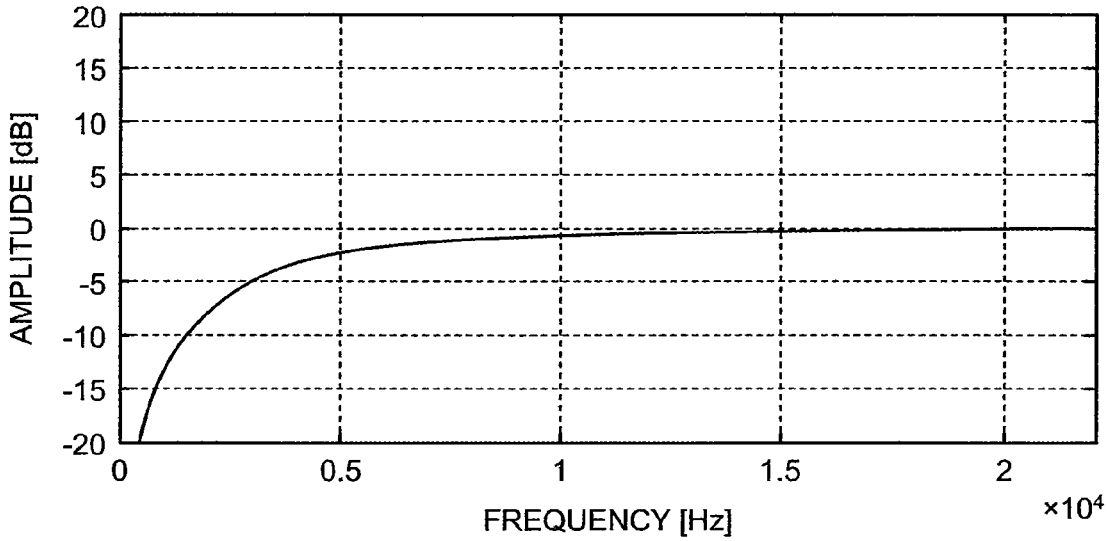
FIG. 12 is an exemplary graph of the relationship between the frequency and gain of a high-pass filter included in the acoustic model in the first embodiment.
Figure 13:
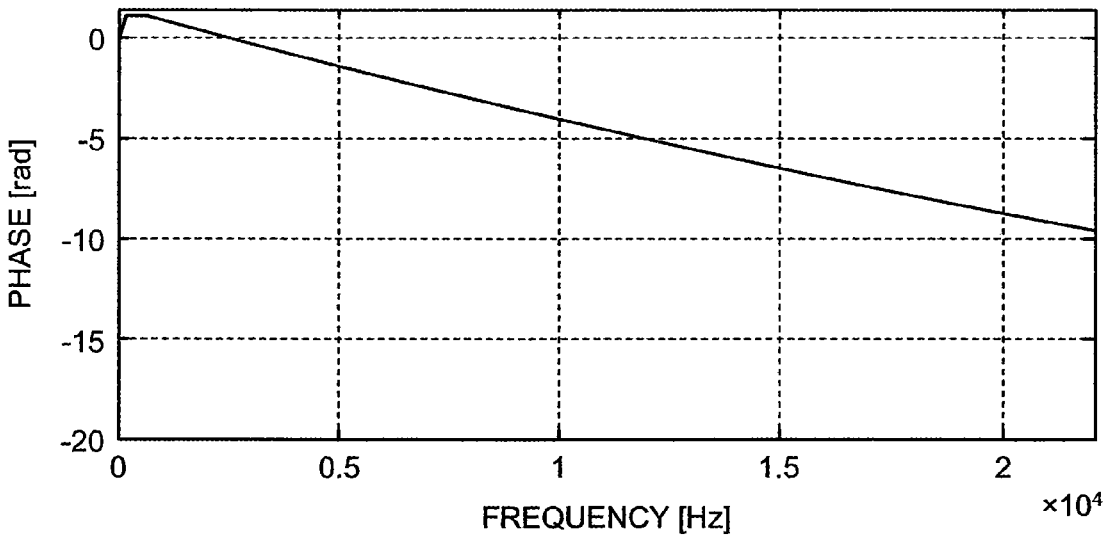
FIG. 13 is an exemplary graph of the relationship between the frequency and phase of the high-pass filter included in the acoustic model in the first embodiment.

FIG. 12 is a graph of the relationship between the frequency characteristics and gain of the filter 1102. FIG. 13 is a graph of the relationship between the frequency characteristics and phase of the filter 1102.

Referring back to FIG. 11, the reflectivity of the earphone 120 is set to the attenuator 1104.

The adder 1105 adds a sound source signal having undergone filtering received from the attenuator 1104 to the input sound source signal.

In other words, an input sound source signal is processed by the delay device 1100, the attenuator 1101, the filter 1102, the delay device 1103, and the attenuator 1104, and then returns. Thereafter, the sound source signal is added to the input sound source signal without passing through the above constituent elements by the adder 1105.

Figure 14:
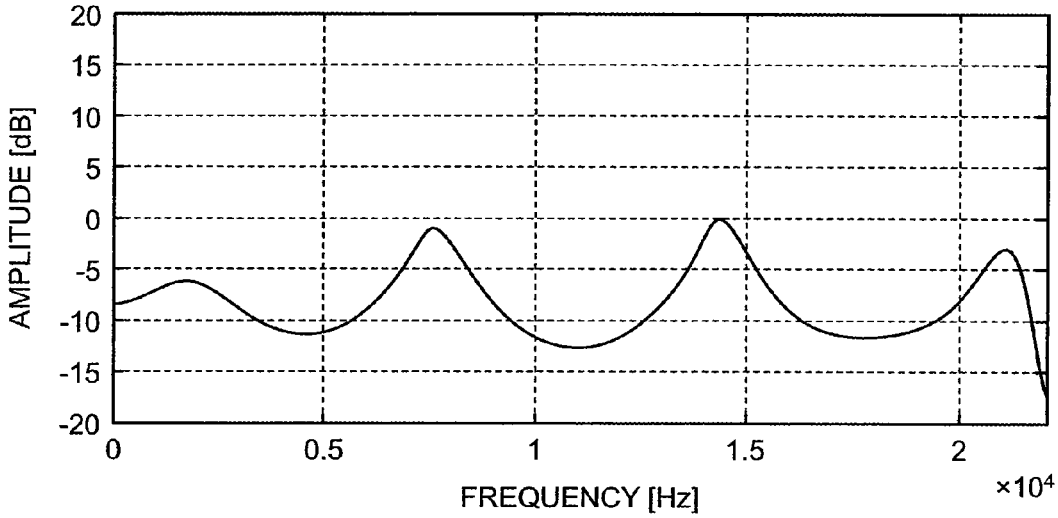
FIG. 14 is an exemplary graph of the relationship between the frequency and gain in the frequency characteristics of the ear canal when an acoustic signal corrected by the correction filter using the acoustic model is output in the first embodiment.
Figure 15:
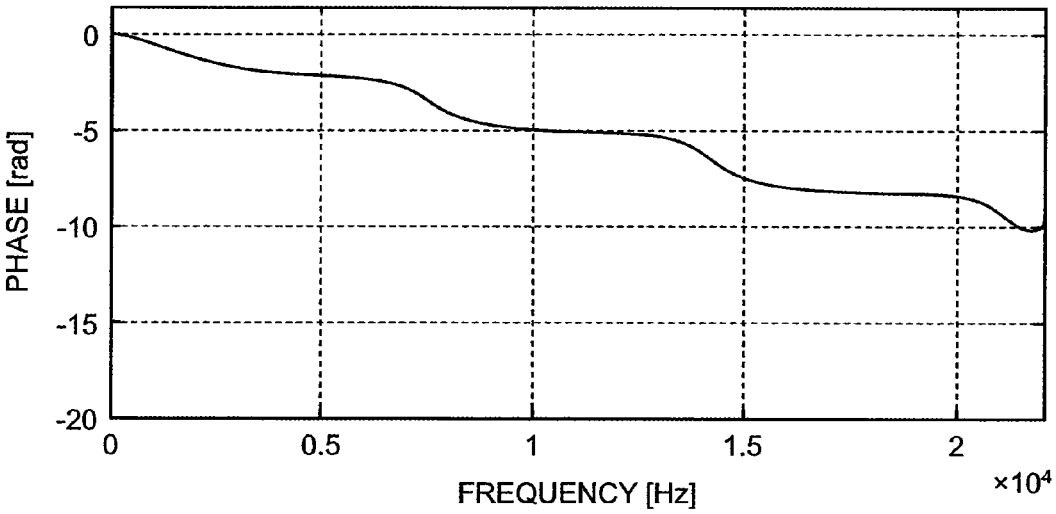
FIG. 15 is an exemplary graph of the relationship between the frequency and phase in the frequency characteristics of the ear canal when an acoustic signal corrected by the correction filter using the acoustic model is output in the first embodiment.

FIGS. 14 and 15 are graphs of the frequency characteristics of the acoustic model described above. FIG. 14 is a graph of the relationship between the frequency characteristics and gain. FIG. 15 is a graph of the relationship between the frequency characteristics and phase. It can be seen that the frequency characteristics at the resonance peak of the acoustic model illustrated in FIG. 14 corresponds to the resonant frequency illustrated in FIG. 5. This means that the correction using a filter based on the acoustic model suppresses the resonance peak as well as avoiding unnatural sound. Further, it is possible to prevent the hearing ability of the user from decreasing. A description will then be given of the relationship between an acoustic model and an adaptive equalization filter applied to the acoustic model.

Figure 16:
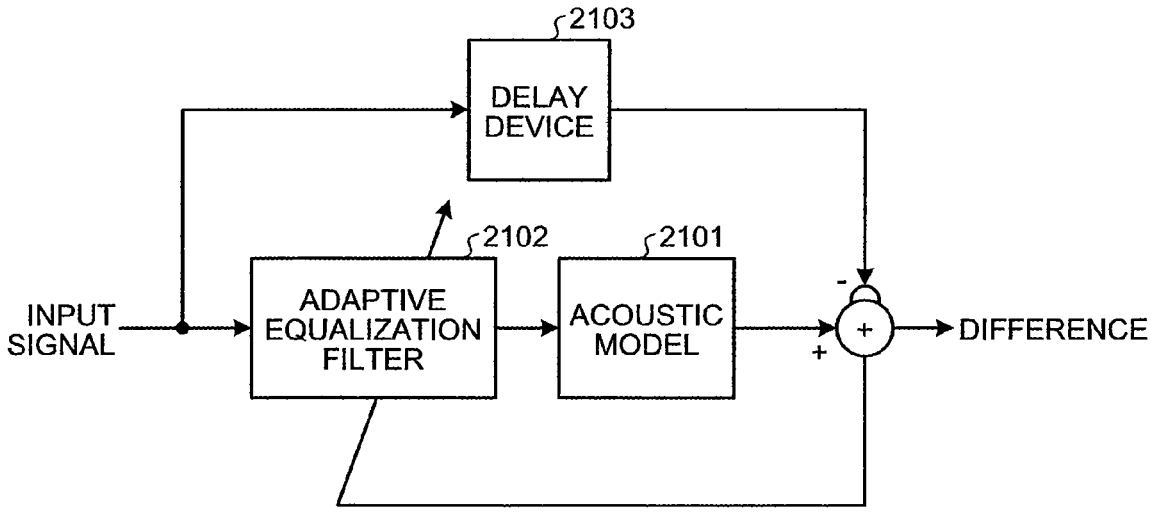
FIG. 16 is an exemplary schematic diagram of the acoustic model and an adaptive equalization filter in the first embodiment.

As illustrated in FIG. 16, an acoustic model 2101 and an adaptive equalization filter 2102 are connected as a series connection circuit. The same value as the coefficient of the adaptive equalization filter 2102 when the difference between an input signal and an output signal is minimum is used.

The difference can be obtained by subtracting an input signal received through a delay device 2103 from an output signal output from the acoustic model 2101. The correction filter 311 can suppress the resonance peak of an acoustic signal by using the difference.

After the correction filter 311 corrects a signal, the electroacoustic transducer 303 converts the signal to an acoustic signal. Then, the sound output module 201 outputs the acoustic signal to the ear canal.

Figure 17:
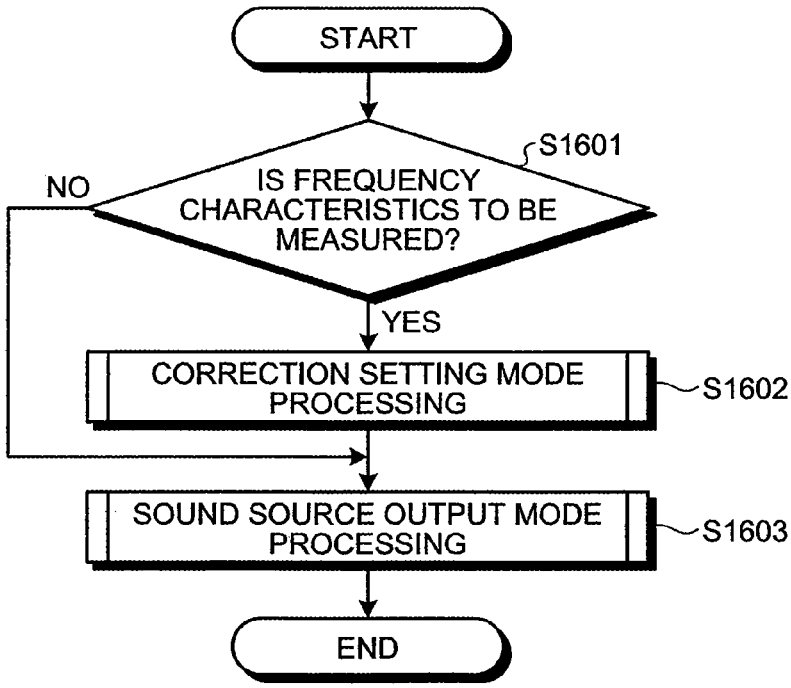
FIG. 17 is an exemplary flowchart of the operation of the acoustic characteristic correction device in the first embodiment.

In the following, a description will be given of the operation of the acoustic characteristic correction device 150 according to the first embodiment. FIG. 17 is a flowchart of the operation of the acoustic characteristic correction device 150.

First, the switch 308 determines whether to measure the frequency characteristics or acoustical properties (S1601). When the switch 308 determines to measure the frequency characteristics (Yes at S1601), the correction setting mode processor 307 performs processing in the correction setting mode, i.e., correction setting mode processing (S1602).

On the other hand, when the switch 308 determines not to measure the frequency characteristics (No at S1601), or after the completion of the processing at S1602, the sound source output mode processor 302 performs processing in the sound source output mode, i.e., sound source output mode processing (S1603). In the manner as described above, the processing is performed in each mode.

Figure 18:
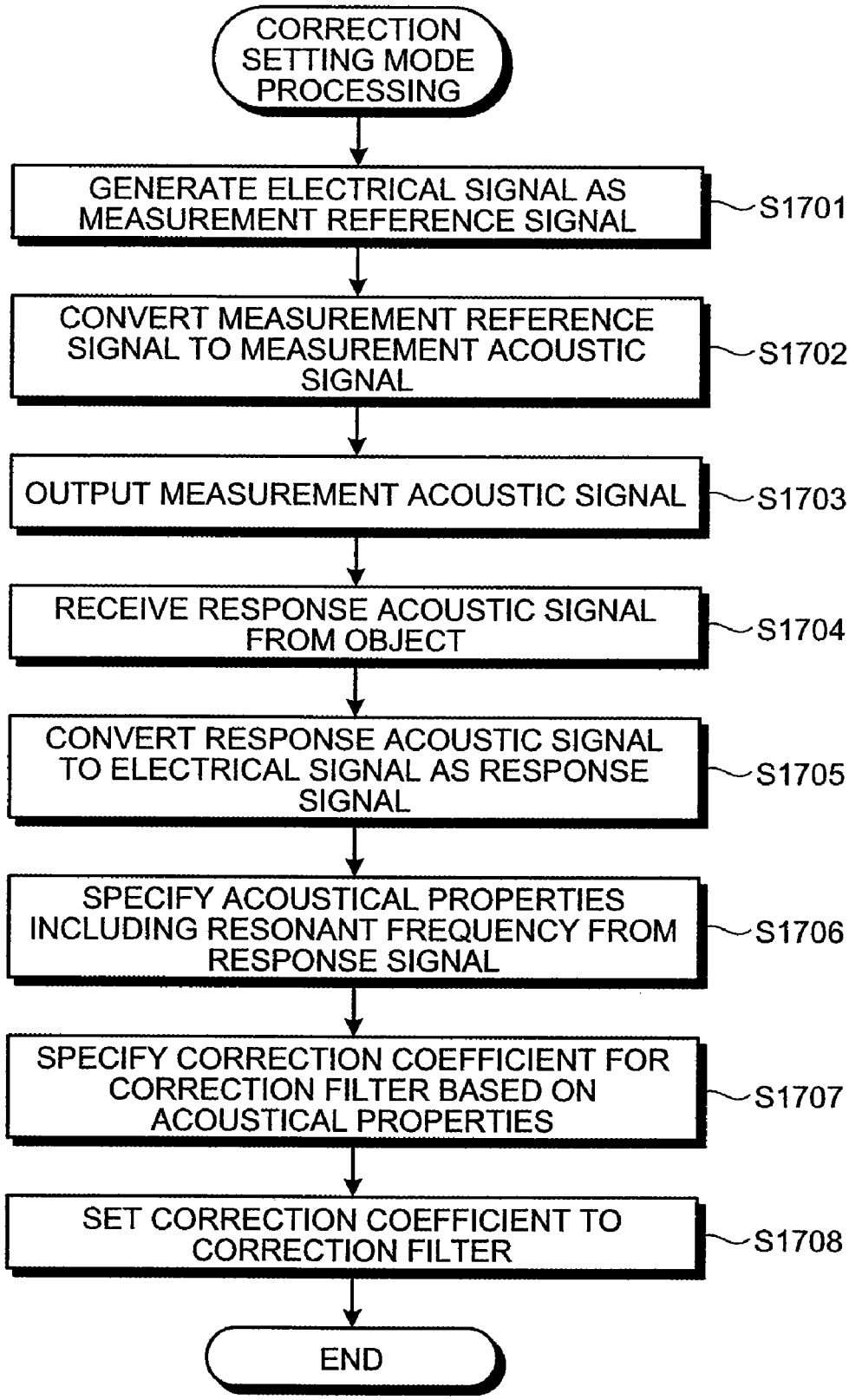
FIG. 18 is an exemplary flowchart of the operation of the acoustic characteristic correction device in correction setting mode in the first embodiment.

A description will now be given of the operation of the acoustic characteristic correction device 150 in the correction setting mode. FIG. 18 is a flowchart of the correction setting mode processing performed by the acoustic characteristic correction device 150.

First, the measurement signal generator 321 generates a measurement reference signal representing an electrical signal to measure the acoustical properties (frequency characteristics) of the ear canal (S1701). Next, the electroacoustic transducer 303 converts the measurement reference signal to a measurement acoustic signal (S1702). Then, the sound output module 201 outputs the measurement acoustic signal to the ear canal (S1703).

After that, the sound input module 202 receives a response acoustic signal reflected from the ear canal (S1704). The acoustoelectric transducer 306 converts the response acoustic signal to an electrical signal as a response signal (S1705).

The response data obtaining module 324 obtains the response signal. Thereafter, the characteristic specifying module 323 specifies the acoustical properties including a resonant frequency (a resonance peak, etc.) from the response signal (S1706). Subsequently, based on the acoustical properties specified by the characteristic specifying module 323, the correction coefficient specifying module 322 creates an acoustic model, and specifies a correction coefficient of the correction filter 311 including the acoustic model and an adaptive equalization filter (S1707). The correction coefficient specifying module 322 then sets the correction coefficient to the correction filter 311 (S1708).

In the manner as described above, a correction coefficient appropriate for the ear canal of the user is set to the correction filter 311.

Figure 19:
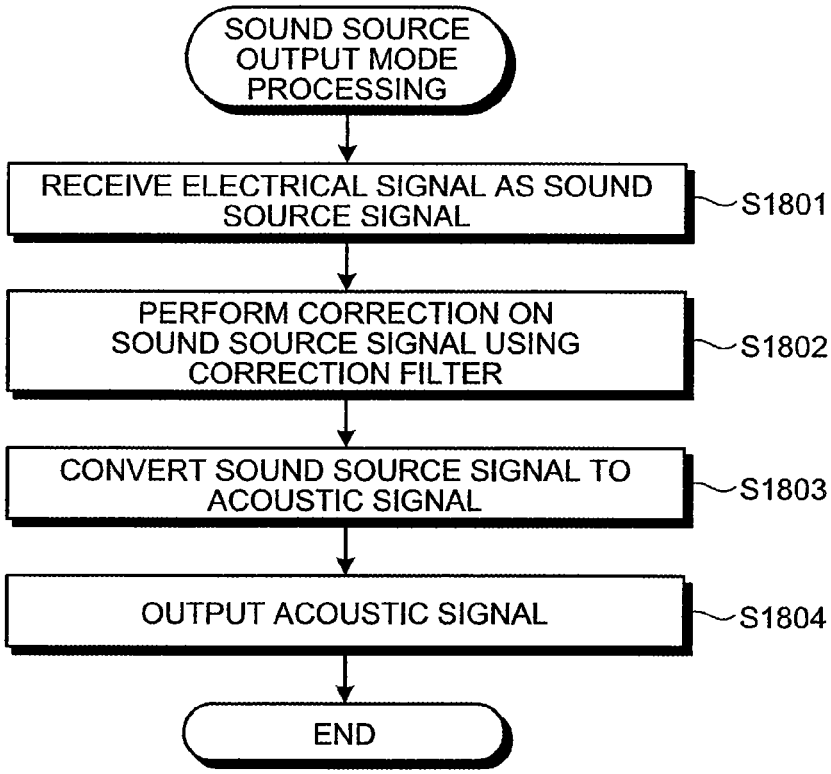
FIG. 19 is an exemplary flowchart of the operation of the acoustic characteristic correction device to output an acoustic signal in the first embodiment.

A description will then be given of the operation of the acoustic characteristic correction device 150 in the sound source output mode to output an acoustic signal. FIG. 19 is a flowchart of the sound source output mode processing performed by the acoustic characteristic correction device 150.

First, the sound source input module 301 receives an electrical signal as a sound source signal from the mobile telephone 110 (S1801).

Next, the correction filter 311 performs correction on the sound source signal (S1802). Then, the electroacoustic transducer 303 converts the sound source signal to an acoustic signal (S1803). Subsequently, the sound output module 201 outputs the acoustic signal to the ear canal (S1804).

In the manner as described above, it is possible to output an acoustic signal on which correction has been performed according to the ear of the user.

Although the first embodiment is described above by taking the earphone 120 as an example, it is not so limited. The first embodiment can also be applied to, for example, a headphone.

As described above, according to the first embodiment, the acoustic characteristic correction device 150 enables correction according to the characteristics of the ear or ears of the individual. Moreover, the acoustic characteristic correction device 150 enables correction according to the difference between the left and right ears and the condition that the earphone is placed.

Furthermore, the acoustic characteristic correction device 150 performs correction to suppress the resonance peak with a filter based on the acoustic model as described above, thereby avoiding unnatural sound without degradation in sound quality. Besides, since the acoustic characteristic correction device 150 uses not the identification results of acoustical properties or the like but the acoustical properties, tuning can be achieved easily with fewer parameters. In addition, the operation can be reduced.

In the first embodiment described above, correction is performed with a correction filter based on the acoustic model as described above; however, it is not so limited. As a modification of the first embodiment, an example will be described in which the parameters of the acoustic model are applied to a reverse filter model. The modification is of basically the same configuration as the first embodiment except for the correction filter, and therefore the sane description will not be repeated.

Figure 20:
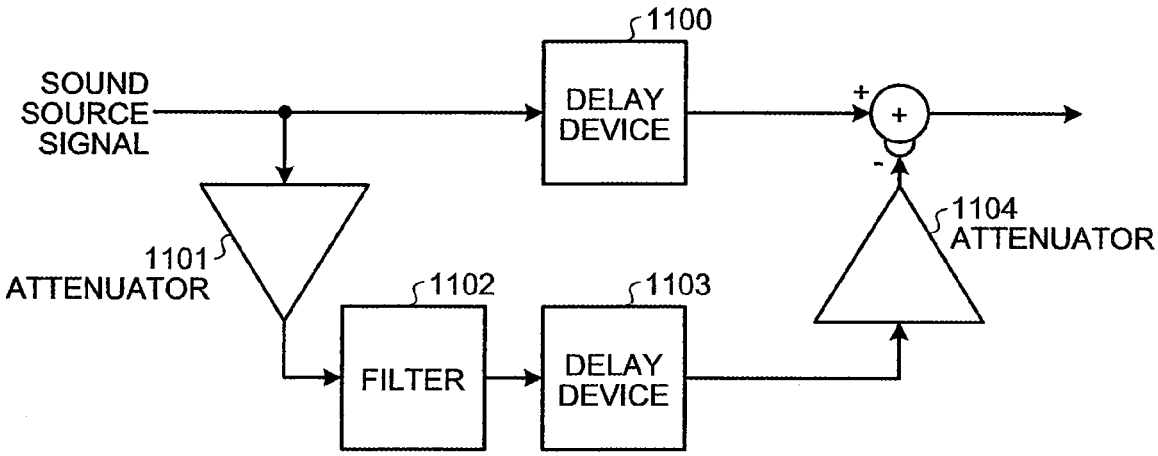
FIG. 20 is an exemplary schematic diagram of a reverse filter model using a correction coefficient specified by the correction coefficient specifying module according to a modification of the first embodiment.

FIG. 20 illustrates an example of the configuration of a reverse filter model using a correction coefficient specified by the correction coefficient specifying module 322 according to the modification. As can be seen from FIG. 20, the reverse filter model comprises the same constituent elements as the acoustic model illustrated in FIG. 11, and only the arrangement of them different. That is, the reverse filter model of the modification is created by modifying the configuration of the acoustic model of the first embodiment. Through the use of the reverse filter model, the resonance peak can be suppressed without using an adaptive equalization filter.

More specifically, in the reverse filter model illustrated in FIG. 20, a propagation time is set to the delay device 1100. The attenuator 1101 represents the reflectivity of the eardrum. The frequency characteristics of the reflectivity is set to the filter 1102. A propagation time is set to the delay device 1103. The attenuator 1104 represents the reflectivity of the earphone. The reverse filter model is configured such that a sound source signal having passed through the attenuator 1101, the filter 1102, the delay device 1103, and the attenuator 1104 is subtracted from the sound source signal having passed through the delay device 1100. Through the use of a filter to which is applied the reverse filter model, a sound source signal is corrected such that the resonance peak is suppressed. As a result, the resonance peak of an acoustic signal can be suppressed.

Figure 21:
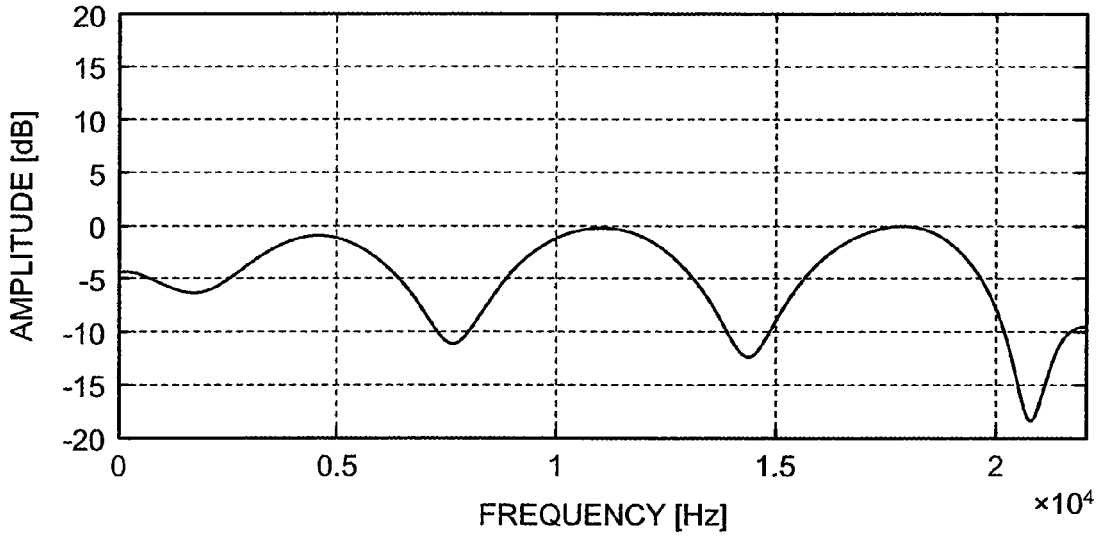
FIG. 21 is an exemplary graph of the relationship between the frequency and gain in the frequency characteristics obtained by the reverse filter model in the modification of the first embodiment.
Figure 22:
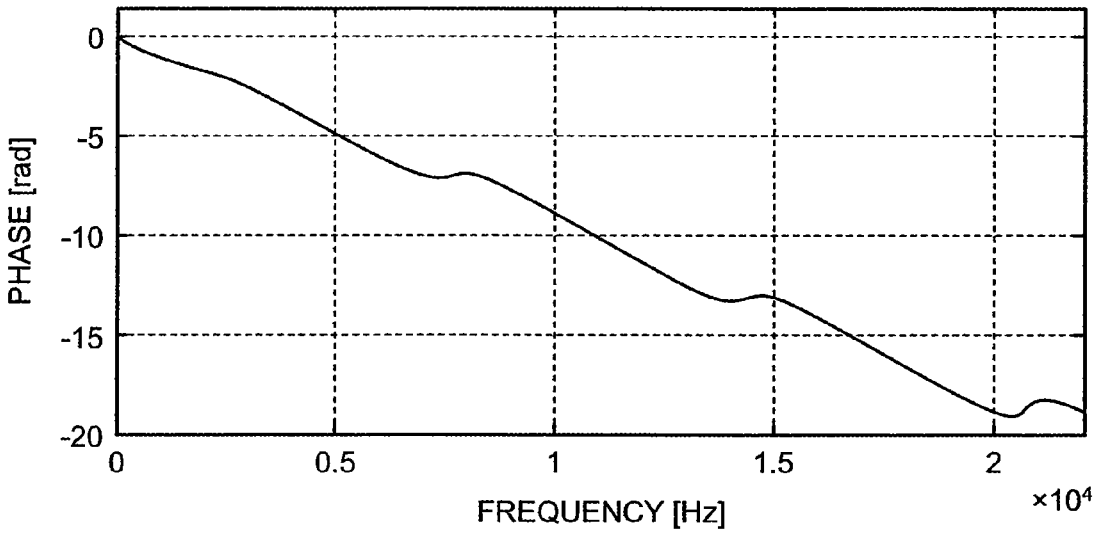
FIG. 22 is an exemplary graph of the relationship between the frequency and phase in the frequency characteristics obtained by the reverse filter model in the modification of the first embodiment.

FIGS. 21 and 22 are graphs of the frequency characteristics of the reverse filter model described above. FIG. 21 is a graph of the relationship between the frequency and gain. FIG. 22 is a graph of the relationship between the frequency and phase Note that the reverse filter model of the modification is also specified based on the acoustical properties obtained form each of the left and right ears of the user. According to the modification, the same effect as in the first embodiment can be achieved.

In the following, a second embodiment of the invention will be described. In the first embodiment, the acoustic characteristic correction device 150 is connected to the mobile telephone 110, and corrects a sound source signal received therefrom. However, the acoustic characteristic correction device 150 is not so limited. For example, a correction characteristic measurement device may only specify a correction coefficient, and the correction coefficient may be set for a correction filter of a sound reproducer.

Figure 23:
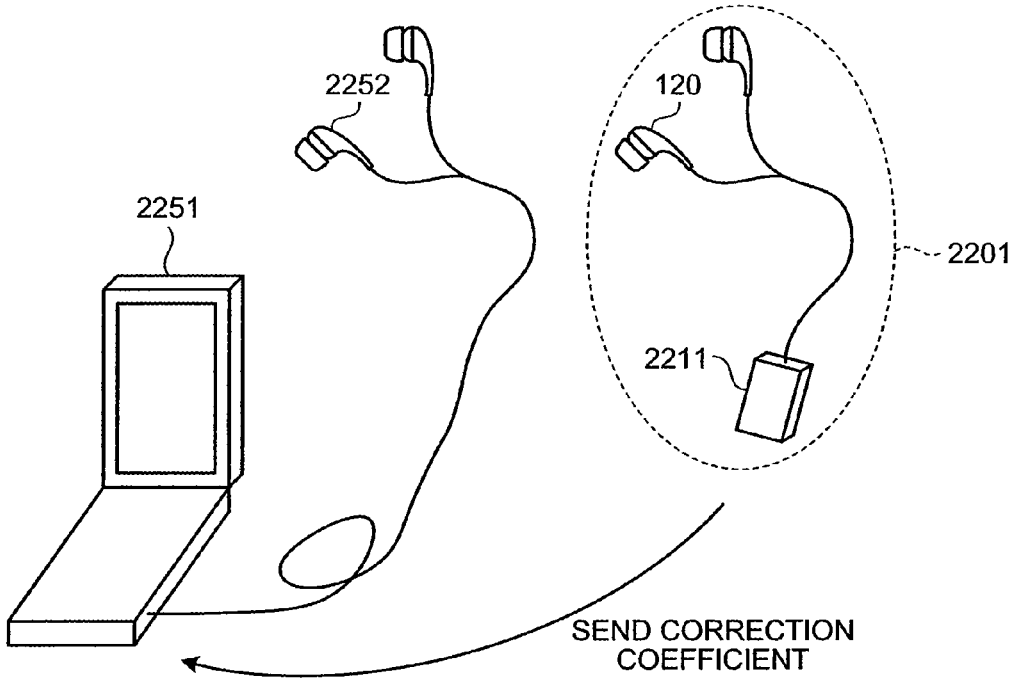
FIG. 23 is an exemplary conceptual diagram of the relationship between a sound reproducer and an acoustic characteristic measurement device according to a second embodiment of the invention.

FIG. 23 illustrates an example of a sound reproducer 2251 and an acoustic characteristic measurement device 2201 according to the second embodiment. As illustrated in FIG. 23, the acoustic characteristic measurement device 2201 comprises the earphone 120 and a main body 2211. The earphone 120 is of basically the same configuration as that of the first embodiment.

The acoustic characteristic measurement device 2201 specifies the acoustical properties of the ear canal. The acoustic characteristic measurement device 2201 then specifies a correction coefficient of a correction filter and outputs the correction coefficient to the sound reproducer 2251. The sound reproducer 2251 performs filtering using the correction coefficient and outputs an acoustic signal. Incidentally, a commonly used earphone 2252 is connected to the sound reproducer 2251.

Figure 24:
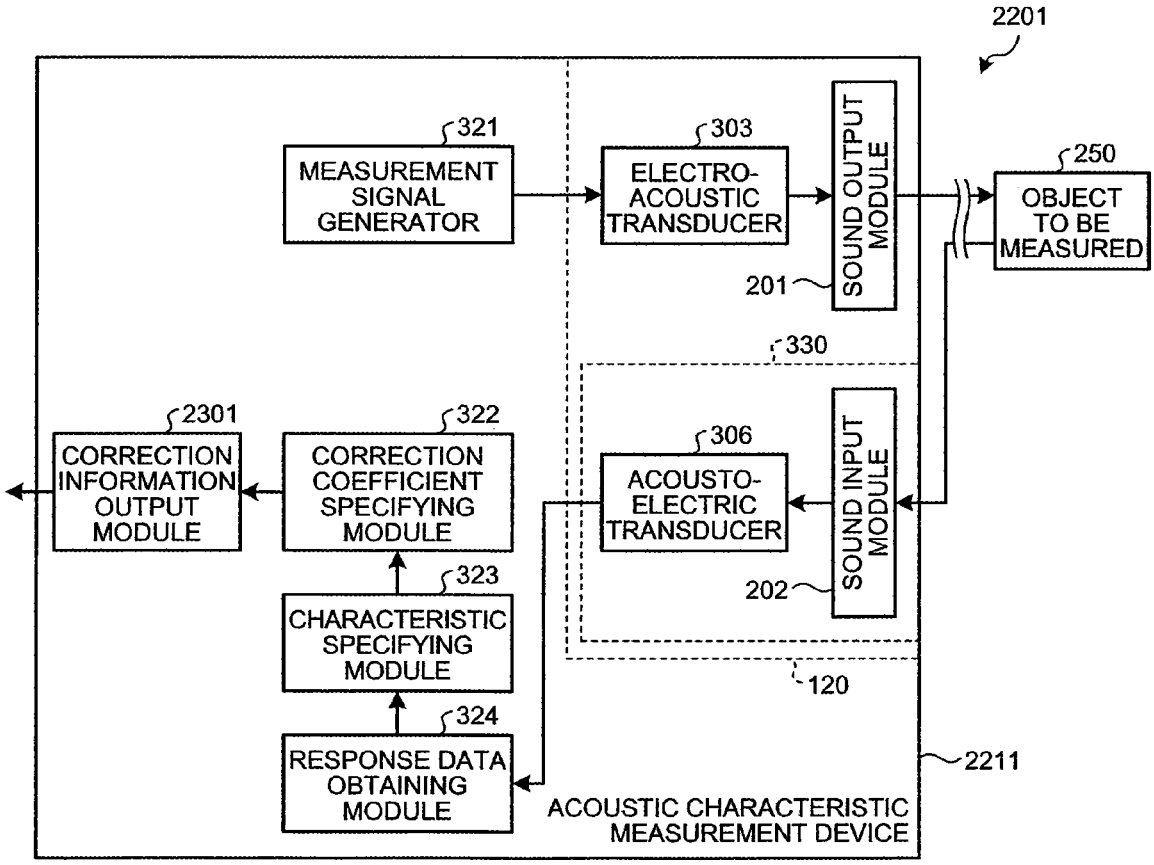
FIG. 24 is an exemplary block diagram of the acoustic characteristic measurement device in the second embodiment.

FIG. 24 is a block diagram of the acoustic characteristic measurement device 2201 of the second embodiment. As illustrated in FIG. 24, the acoustic characteristic measurement device 2201 comprises the main body 2211 and the earphone 120. Constituent elements corresponding to those of the first embodiment are designated by the same reference numerals, and their description will not be repeated.

The main body 2211 comprises the measurement signal generator 321, the correction coefficient specifying module 322, the characteristic specifying module 323, the response data obtaining module 324, and a correction information output module 2301.

After a correction coefficient is specified in the same manner as described in the first embodiment, the correction information output module 2301 outputs the correction coefficient to the sound reproducer 2251. With this, the sound reproducer 2251 can correct a sound source signal with a correction filter to which is set the correction coefficient received from the correction information output module 2301. Thus, the same effect as in the first embodiment can be achieved.

Although specific embodiments have been described and illustrated, the embodiments are not to be limited to the specific forms or arrangements of parts so described and illustrated. The embodiments are susceptible to several modifications and variations, and some examples will be described.

Not only the acoustic model described in the first and second embodiments and the reverse filter model to which is applied the acoustic model of the modification of the first embodiment, but also various other acoustic models may be used.

Therefore, as examples of modifications, a description will be given of an acoustic model having a different configuration. The modifications are of basically the same configuration as the above embodiments and the modification of the first embodiment except for the acoustic model, and therefore the same description will not be repeated.

Figure 25:
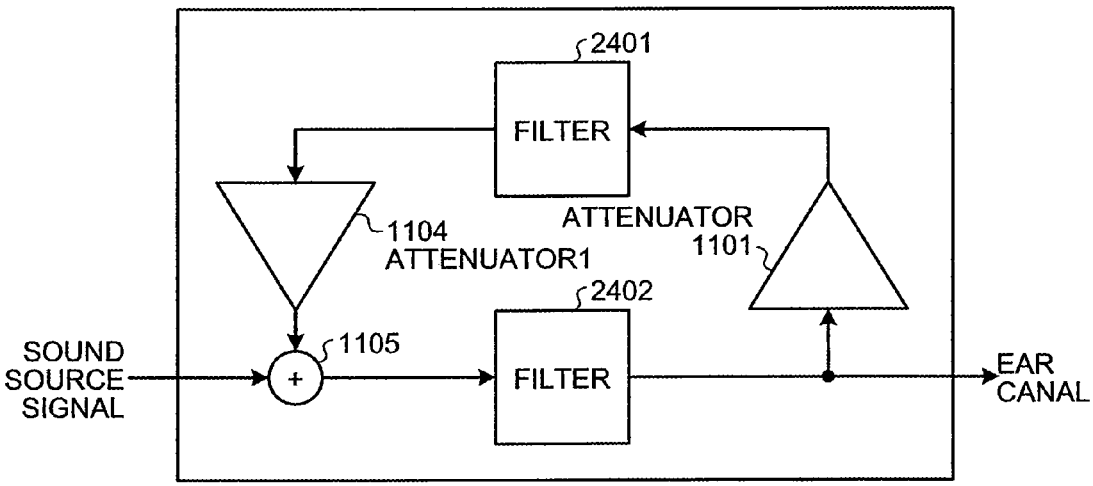
FIG. 25 is an exemplary schematic diagram of an acoustic model according to a first modification of the embodiments.

FIG. 25 is a schematic diagram of an acoustic model according to a first modification of the embodiments. In the example of FIG. 25, an acoustic model comprises filters 2401 and 2402, the attenuators 1101 and 1104, and the adder 1105. The filters 2401 and 2402 each include delay time specified by the correction coefficient specifying module 322. Correction can be performed with the acoustic model of this configuration.

Figure 26:
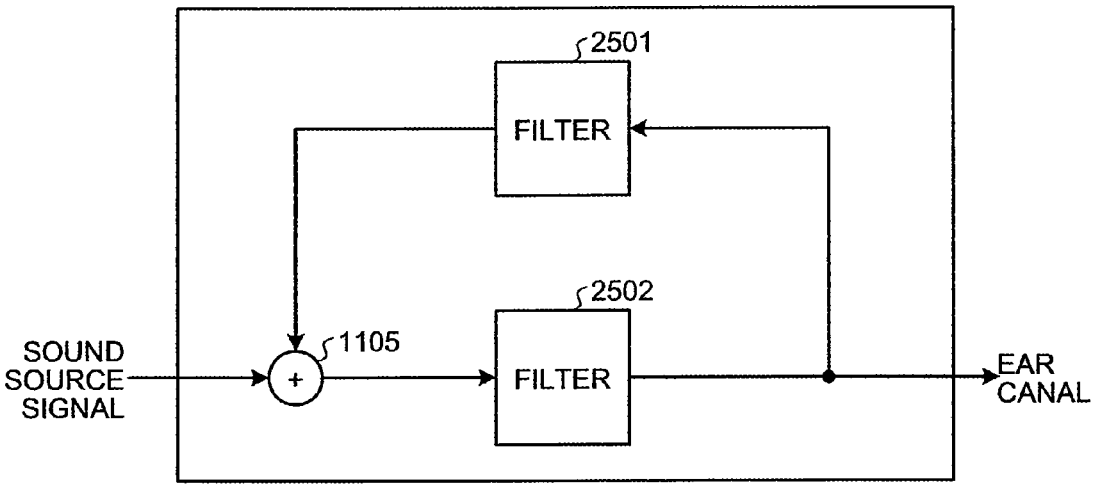
FIG. 26 is an exemplary schematic diagram of an acoustic model according to a second modification of the embodiments.

FIG. 26 is a schematic diagram of an acoustic model according to a second modification of the embodiments. In the example of FIG. 26, an acoustic model comprises filters 2501 and 2502, and the adder 1105. The filters 2501 and 2502 each include delay time and reflectivity specified by the correction coefficient specifying module 322. Correction can be performed with the acoustic model of this configuration.

Figure 27:
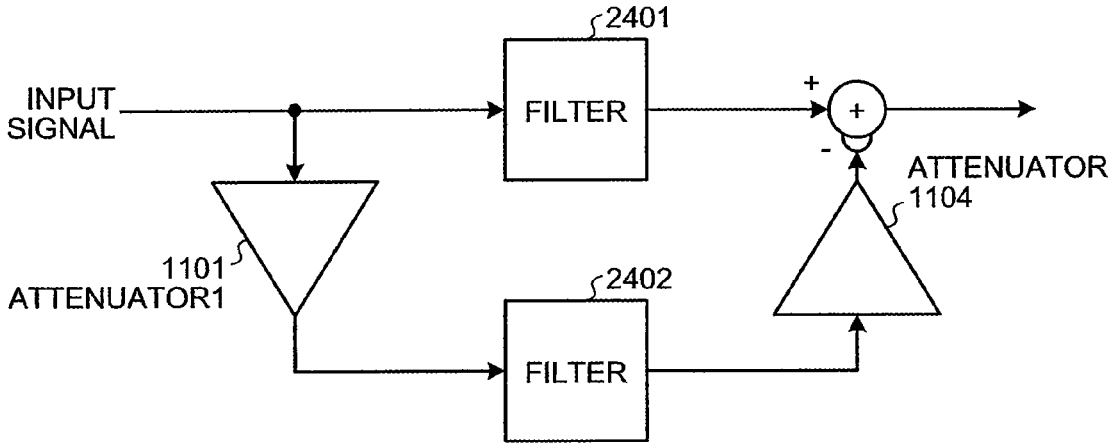
FIG. 27 is an exemplary schematic diagram of a reverse filter model using parameters of the acoustic model illustrated in FIG. 25 according to a third modification of the embodiments.

FIG. 27 is a schematic diagram of a reverse filter model using parameters of the acoustic model illustrated in FIG. 25 according to a third modification of the embodiments. Such a reverse filter model may also be used.

Figure 28:
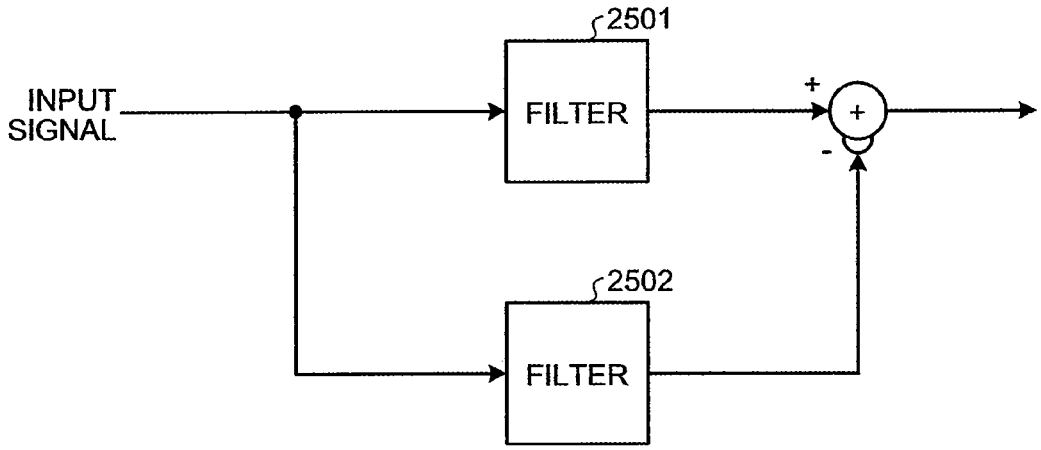
FIG. 28 is an exemplary schematic diagram of a reverse filter model using parameters of the acoustic model illustrated in FIG. 26 according to a fourth modification of the embodiments.

FIG. 28 is a schematic diagram of a reverse filter model using parameters of the acoustic model illustrated in FIG. 26 according to a fourth modification of the embodiments. Such a reverse filter model may also be used.

Through the use of the acoustic models and the reverse filter models of the modification as described above, the same effect as in the first embodiment can be achieved.

Incidentally, a computer program (hereinafter "acoustic characteristic correction program") may be executed on a computer to realize the same function as the acoustic characteristic correction device 150. Similarly, a computer program (hereinafter "acoustic characteristic measurement program") may be executed on a computer to realize the same function as the acoustic characteristic measurement device 2201. The acoustic characteristic correction program and the acoustic characteristic measurement program may be provided as being stored in advance in a read only memory (ROM) or the like.

The acoustic characteristic correction program and the acoustic characteristic measurement program may also be provided as being stored in a computer-readable storage medium, such as a compact disk-read only memory (CD-ROM), a flexible disk (FD), a compact disc-recordable (CD-R), or a digital versatile disc (DVD), as a file in an installable or executable format.

Further, the acoustic characteristic correction program and the acoustic characteristic measurement program may also be stored in a computer connected via a network such as the Internet so that it can be downloaded therefrom. Still further, the acoustic characteristic correction program and the acoustic characteristic measurement program may also be provided or distributed via a network such as the Internet.

The acoustic characteristic correction program and the acoustic characteristic measurement program each include modules that implement the respective constituent elements described above. As hardware, a central processing unit (CPU) loads the acoustic characteristic correction program or the acoustic characteristic measurement program from the ROM or the like into a main storage device and executes it. Thus, the respective constituent elements are implemented on the main storage device.

The various modules of the systems described herein can be implemented as software applications, hardware and/or software modules, or components on one or more computers, such as servers. While the various modules are illustrated separately, they may share some or all of the same underlying logic or code.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A sound corrector comprising:

a signal outputter configured to output a measurement signal to measure acoustical properties of an object to be measured;

a response signal receiver configured to receive a response signal from the object in response to the measurement signal;

a frequency specifier configured to specify a resonant frequency at a resonance peak from a frequency characteristic of the response signal;

a coefficient specifier configured to create an acoustic model at a position of the object which is equivalent to a position of the response signal receiver based on the resonant frequency, and specify a correction coefficient of a correction filter for reducing a resonant frequency component specified from the acoustic model;

a filter configured to perform filtering on an input signal that is input to the filter, using the correction filter with the correction coefficient; and an outputter configured to output the filtered input signal to the object, wherein the frequency specifier is configured to further specify a sound pressure level at the resonance peak, and the coefficient specifier is configured to specify a propagation time to the object as the correction coefficient, the filter including a delay module in which the propagation time is set, to process the input signal, and an attenuator configured to represent reflectivity based on the sound pressure level, to process the input signal, and the filter being configured such that the input signal processed by the delay module and the attenuator is added to the input signal that has not been processed by the delay module and the attenuator, and to output the sum of the input signal processed by the delay module and the attenuator and the input signal that has not been processed by the delay module and the attenuator to the outputter as the filtered input signal.

2. The sound corrector of claim 1, further comprising a switch configured to switch between a first operation mode for measuring the acoustical properties of the object and a second operation mode for correcting the input signal, wherein in the first operation mode, the signal outputter, the response signal receiver, the frequency specifier, and the coefficient specifier perform processing, and in the second operation mode, the filter and the outputter perform processing.

3. The sound corrector of claim 1, wherein the signal outputter and the outputter are configured to be identical in configuration, and the response signal receiver is configured to be located at a position except for a node of sound pressure of a standing wave of the measurement signal.

4. The sound corrector of claim 3, wherein the response signal receiver is configured to be located near the signal outputter.

5. The sound corrector of claim 1, wherein the measurement signal is one of a unit pulse, a time stretched pulse, white noise, noise in a band including a measurement band, and a signal containing a plurality of sinusoidal waves including a sinusoidal wave in the measurement band.

6. A sound measurement device comprising:

a signal outputter configured to output a measurement signal to measure acoustical properties of an object to be measured;

a response signal receiver configured to receive a response signal reflected from the object;

a frequency specifier configured to specify a resonant frequency at a resonance peak from a frequency characteristic of the response signal;

a coefficient specifier configured to create an acoustic model at a position of the object which is equivalent to a position of the response signal receiver based on the resonant frequency, and specify a correction coefficient of a correction filter for reducing a resonant frequency component specified from the acoustic model; and a coefficient outputter configured to output the correction coefficient, wherein the frequency specifier is configured to further specify a sound pressure level at the resonance peak, and the coefficient specifier is configured to specify a propagation time to the object as the correction coefficient, the sound measurement device further comprising a filter configured to receive an input signal, the filter comprising a delay module in which the propagation time is set, to process the input signal, and an attenuator configured to represent reflectivity based on the sound pressure level, to process the input signal, and wherein the filter is configured such that the signal processed by the delay module and the attenuator is added to the input signal that has not been processed by the delay module and the attenuator, and to output the sum of the input signal processed by the delay module and the attenuator and the input signal that has not been processed by the delay module and the attenuator as a filtered input signal.

7. A sound correction method applied to a sound corrector, the sound correction method comprising:

outputting a measurement signal to measure acoustical properties of an object to be measured;

receiving a response signal from the object in response to the measurement signal;

specifying a resonant frequency at a resonance peak from a frequency characteristic of the response signal;

creating an acoustic model at a position of the object based on the resonant frequency, and specifying a correction coefficient of a correction filter for reducing a resonant frequency component specified from the acoustic model;

performing filtering on an input signal using the correction filter with the correction coefficient; and outputting the the filtered input signal to the object, wherein:

said specifying the resonant frequency comprises specifying a sound pressure level at the resonance peak;

said creating comprises specifying a propagation time to the object as the correction coefficient; and said performing the filtering comprises adding the input signal that has been delayed and attenuated by a delay module and an attenuator to the input signal that has not been processed by the delay module and the attenuator, and output the sum of the input signal processed by the delay module and the attenuator and the input signal that has not been processed by the delay module and the attenuator as a filtered input signal, the propagation time being set in the delay module, and the attenuator representing reflectivity based on the sound pressure level at the resonance peak.

8. The sound correction method of claim 7, further comprising a switch switching between a first operation mode for measuring the acoustical properties of the object and a second operation mode for correcting the input signal, wherein in the first operation mode, the outputting the measurement signal, the receiving, the specifying the resonant frequency, the creating and specifying the correction coefficient are performed, and in the second operation mode, the performing the filtering and the outputting the output signal are performed.

* * * * *